US006532927B2

(12) United States Patent
Suzuki et al.

(10) Patent No.: US 6,532,927 B2
(45) Date of Patent: Mar. 18, 2003

(54) VALVE CAM MECHANISM FOR FOUR-CYCLE ENGINE

(75) Inventors: Hiroyuki Suzuki, Shizuoka (JP); Katsumi Ochiai, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/777,001

(22) Filed: Feb. 5, 2001

(65) Prior Publication Data

US 2001/0017119 A1 Aug. 30, 2001

(30) Foreign Application Priority Data

Feb. 4, 2000 (JP) ..... 2000-027561

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | | |
|---|---|---|---|---|
| 2,530,623 A | | 11/1950 | Martin | 123/185.14 |
| 3,395,689 A | * | 8/1968 | Kruse | 123/182.1 |
| 4,453,507 A | | 6/1984 | Braun et al. | 123/182.1 |
| 4,570,584 A | | 2/1986 | Uetsuji et al. | 123/179.26 |
| 4,590,905 A | | 5/1986 | Matsuki et al. | 123/321 |
| 5,150,674 A | | 9/1992 | Gracyalny | 123/182.1 |
| 5,687,683 A | | 11/1997 | Knoblauch | 123/182.1 |
| 5,816,208 A | | 10/1998 | Kimura | 123/182.1 |

OTHER PUBLICATIONS

Co–pending patent application: Ser. No. 09/759,608, filed Jan. 12, 2001, entitled Valve Cam Mechanism for Four–Cycle Engine, in the name of Suzuki et al., and assigned to Sanshin Kogyo Kabushiki Kaisha.

* cited by examiner

*Primary Examiner*—Andrew M. Dolinar
(74) *Attorney, Agent, or Firm*—Knobbe, Martens, Olson & Bear LLP

(57) ABSTRACT

A valve cam mechanism for a four-cycle engine includes an improved construction. The engine includes at least one camshaft having cam lobes to activate at least one of an intake valve and an exhaust valve. The camshaft defines an aperture next to at least one of the cam lobes. The aperture extends generally normal to an axis of the camshaft. A decompression mechanism is provided for manual starting of the engine. The decompression mechanism includes a shaft extending through the aperture. An actuator is affixed to the shaft for pivotal movement about an axis of the shaft. The actuator has a first section arranged to hold the intake or exhaust valve in an open position when the actuator exists in an initial position. A second section is arranged to initially retain the actuator in the initial position and to release the actuator from the initial position when the camshaft rotates. The shaft is rigidly supported by an inner surface of the aperture in part. A space is defined between the shaft and the inner surface of the aperture in the rest part.

23 Claims, 8 Drawing Sheets

VALVE CAM MECHANISM FOR FOUR-CYCLE ENGINE

PRIORITY INFORMATION

This application is based on and claims priority to Japanese Patent Application No. 2000-27561, filed Feb. 4, 2000, the entire contents of which is hereby expressly incorporated by reference.

BACKGROUND OF THE INVENTION

1. Field of the Invention

This invention relates to a valve cam mechanism for a four-cycle engine, and more particularly to an improved valve cam mechanism that decompresses a combustion chamber for easy starting of a four-cycle engine.

2. Description of Related Art

All internal combustion engines have starting mechanisms. In many applications, the starting mechanism is an electrical device that is operable with a key by the operator. This device provides an easy way to start the engine. Some simpler engines, however, use a manual starting device in order to keep the engine compact. For instance, it is frequently the practice in outboard motors, and particularly those of small displacement, to incorporate a mechanism whereby the engine may be manually started. This is normally done by a rope or recoil starter that is associated with a flywheel disposed atop the crankshaft of the engine.

In order to achieve good engine performance, it is a practice to use relatively high compression ratios. The use of such high compression ratios, however, gives rise to a rather large force that must be overcome by the operator to effect manual starting. There have been, therefore, proposed types of decompression mechanisms which effectively lower the compression ratio of the engine during manual starting. Preferably, such devices are automatic in nature wherein the compression ratio is lowered only long enough to facilitate starting and not long enough to interfere with the operation of the engine once starting has been accomplished. That is, the decompression mechanism should be released promptly when engine is started and the decompression mechanism should not operate above a selected idle engine speed.

Occasionally, engines such as those provided on, for example, outboard motors and lawn mowers have camshafts extending generally vertically. A proposed decompression mechanism for these engines has a construction in which an actuator is mounted on a camshaft for pivotal movement about a pivot axis extending generally normal to an axis of the camshaft. The actuator may have a holder section which is arranged to hold, for example, an exhaust valve in an open position when the actuator exists in an initial position. If the engine has a rocker arm which is periodically lifted by the camshaft to actuate the exhaust valve, the holder section can hold the rocker arm instead of directly holding the exhaust valve. The actuator also has a weight section that places the holder section in the initial position by the gravity, i.e., by its own weight, and moves by centrifugal forces, which are produced by camshaft rotation, to release the exhaust valve such that the exhaust valve can properly close.

When the holder section is in the initial position, the exhaust valve is held in the open position in which a combustion chamber of the engine communicates with the atmosphere. Because no compression force or a reduced compression force is developed in the combustion chamber under this condition, the operator can manually start the engine. Once the engine starts, the camshaft rotates and the actuator is released from the initial position by the movement of the weight section. The combustion chamber no longer communicates with the atmosphere under this condition and normal running of the engine is thus assured. U.S. Pat. Nos. 4,453,507 and 5,150,674 disclose decompression mechanisms in which actuators directly hold valves during engine starting.

Typically, the camshaft defines an aperture extending generally normal to the axis of the camshaft. A shaft of a decompression mechanism is provided through the aperture so as to pivotally mount the actuator on the camshaft. The shaft is press-fit into the aperture. This press-fitting, however, may cause the camshaft to be bent slightly when the shaft is inserted. Thus, the camshaft is no longer straight.

One reason that the camshaft is susceptible to bending is that the shaft must be cold press fit rather that hot press fit. As will be appreciated, the camshaft has cam lobes that comprise a heat treated layer to protect the cam lobes from abrasion during operation. Because hot press fitting can harm the heat treated layers, cold press fitting must be used. Cold press fitting, however, requires a relatively large load as compared to than hot press fitting. The large load can cause deformation of the camshaft.

In addition, camshafts comprise a number of portions that have rather tight dimensional tolerances, such as cam lobes and journals. Thus, the camshaft generally cannot be supported in these regions during press fitting. Instead, the camshaft must be supported elsewhere. These supported regions, therefore, are greatly spaced from the region in which the actuator is being mounted. Accordingly, the bending moment exerted upon the camshaft is greatly increased.

Therefore, a need exists for an improved valve cam mechanism that can substantially reduce any undesired camshaft deformation during installation of a decompression mechanism.

It should be noted that a decompression mechanism that is mounted on a camshaft can suffer from another problem. Namely, chips produced during machining processes or wear dust accumulated during engine operation can adhere onto the coupling portions of the actuator with the decompression shaft. If this occurs, the shaft may not pivot smoothly and the desired operation of the decompression mechanism may fail.

Another need, thus, exists for an improved valve cam mechanism that can maintain smooth operation of a decompression mechanism without requiring special maintenance operations or frequently cleaning.

SUMMARY OF THE INVENTION

In accordance with one aspect of the present invention, an internal combustion engine comprises a cylinder block defining at least one cylinder bore. A piston reciprocates in the cylinder bore. A cylinder head member closes one end of the cylinder bore and defines a combustion chamber with the cylinder bore and the piston. An intake passage has an intake port through which air is introduced into the combustion chamber. An intake valve is arranged to open and close the intake port. An exhaust passage has an exhaust port through which exhaust products are discharged from the combustion chamber. An exhaust valve is arranged to open and close the exhaust port. At least one camshaft is arranged for rotation and has cam lobes to activate at least one of the intake valve and the exhaust valve. The camshaft comprises an aperture that extends therethrough and that is positioned next to at least one of the cam lobes. The aperture extends generally normal to an axis of the camshaft. A decompression mechanism is configured to decompress the combustion chamber for manual starting of the engine. The decompression mechanism includes a shaft extending through the aperture. An actuator is affixed to the shaft for pivotal movement about an axis of the shaft. The actuator has a first section arranged to hold at least one of the intake valve and the exhaust valve in an open position when the actuator exists in an initial position. A second section is arranged to initially retain the actuator in the initial position and to release the actuator from the initial position when the camshaft rotates. The shaft is rigidly supported by an inner surface of the aperture. A space is defined between the shaft and at least a portion of the inner surface of the aperture.

In accordance with another aspect of the present invention, an internal combustion engine comprises a combustion chamber. A valve is arranged to open and close the combustion chamber to the atmosphere. A camshaft is arranged for rotation and has a cam lobe to activate the valve. The camshaft defines an aperture adjacent to the cam lobe. The aperture extends generally normal to an axis of the camshaft. A pin extends through the aperture. An actuator is affixed to the pin for pivotal movement about an axis of the pin. The actuator includes a first section arranged to hold the valve in an open position when the actuator exists in an initial position. A second section is arranged to initially retain the actuator in the initial position and to release the actuator from the initial position when the camshaft rotates. The pin is rigidly supported by an inner surface of the aperture in part. A space is defined between the pin and the inner surface of the aperture in the rest part.

In accordance with a further aspect of the present invention, a valve cam mechanism for four-cycle engine having a combustion chamber comprises a valve arranged to open and close the combustion chamber to the atmosphere. A camshaft extends generally vertically. The camshaft is arranged for rotation and has a cam lobe to activate the valve. The camshaft defines an aperture adjacent to the cam lobe. The aperture extends generally normal to an axis of the camshaft. A pin extends through the aperture. An actuator is affixed to the pin for pivotal movement about an axis of the pin. The actuator includes a holder section arranged to hold the valve in an open position when the actuator exists in an initial position. A weight section is disposed opposite to the holder section relative to the axis of the pin so as to place the holder section in the initial position. The actuator pivots about the axis of the pin when the weight moves by centrifugal force produced by the rotation of the camshaft so as to release the holder section from holding the valve in the open position. The pin is rigidly supported by an inner surface of the aperture in part. A space is defined between the pin and the inner surface of the aperture in the rest part.

Further aspects, features and advantages of this invention will become apparent from the detailed description of the preferred embodiments which follow.

BRIEF DESCRIPTION OF THE DRAWINGS

These and other features, aspects and advantages of the present invention will now be described with reference to the drawings of a couple of preferred embodiments which are intended to illustrate and not to limit the invention. The drawings comprise twelve figures.

DETAILED DESCRIPTION OF THE PREFERRED EMBODIMENTS OF THE INVENTION

Figure 1:
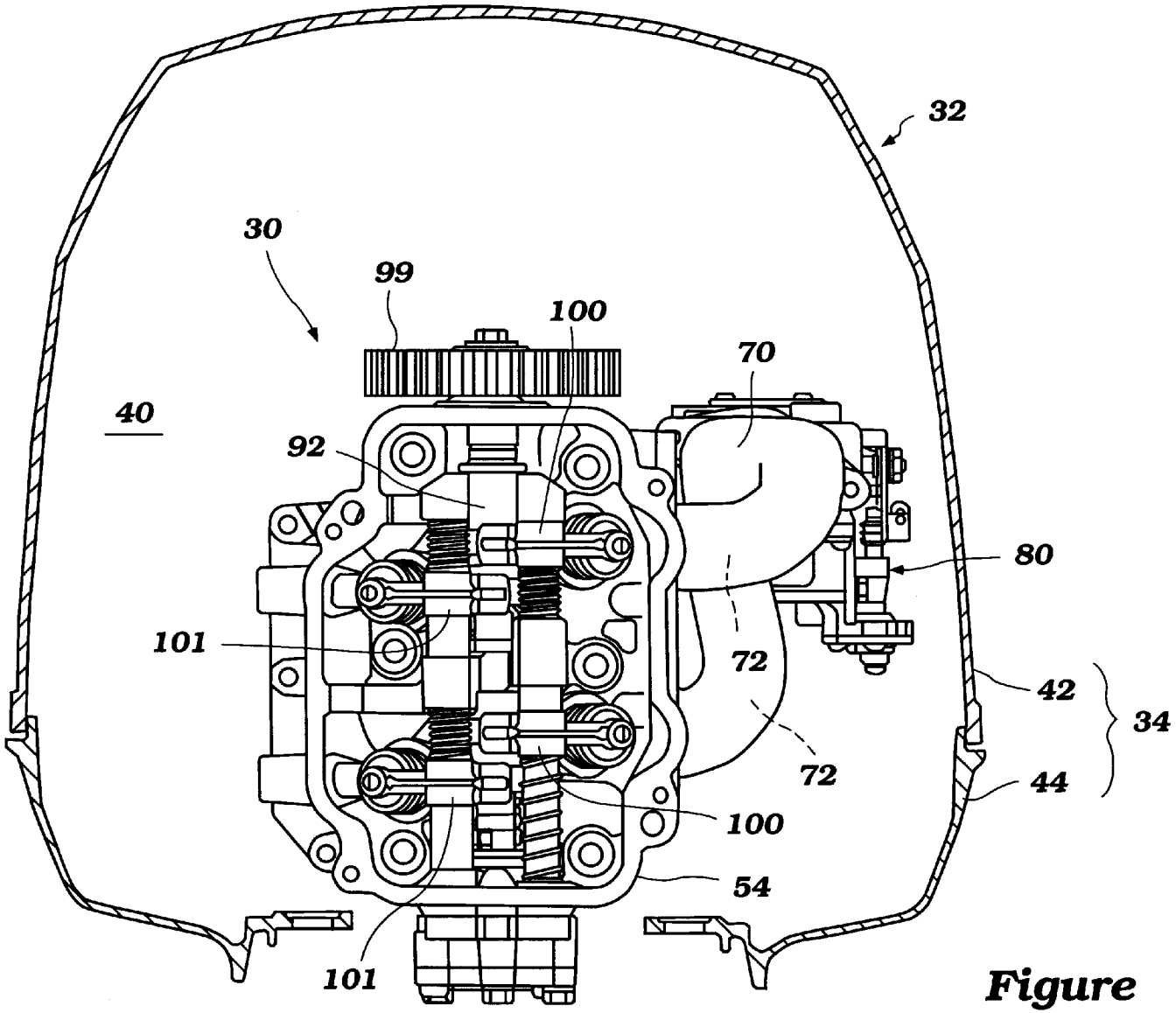
FIG. 1 is a simplified rear view of a power head employing a decompression mechanism arranged in accordance with a preferred embodiment of the present invention. An engine is shown without a cylinder head cover. A protective cowling is shown in section.
Figure 2:
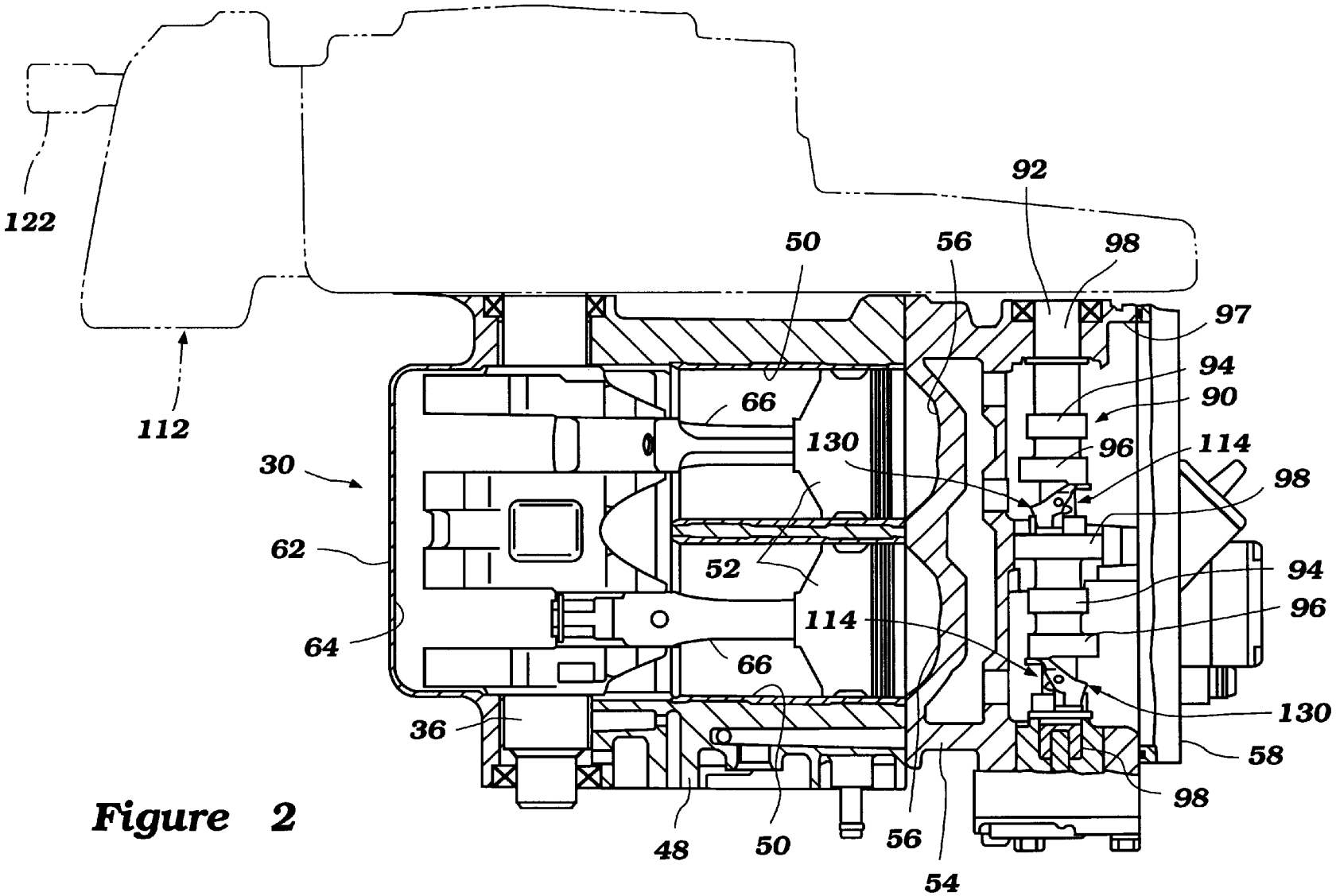
FIG. 2 is a side elevational view of the engine. A large portion of the engine, except for a manual starter assembly and a portion of the cylinder head cover, is shown in section. The manual starter assembly is shown in phantom.
Figure 3:
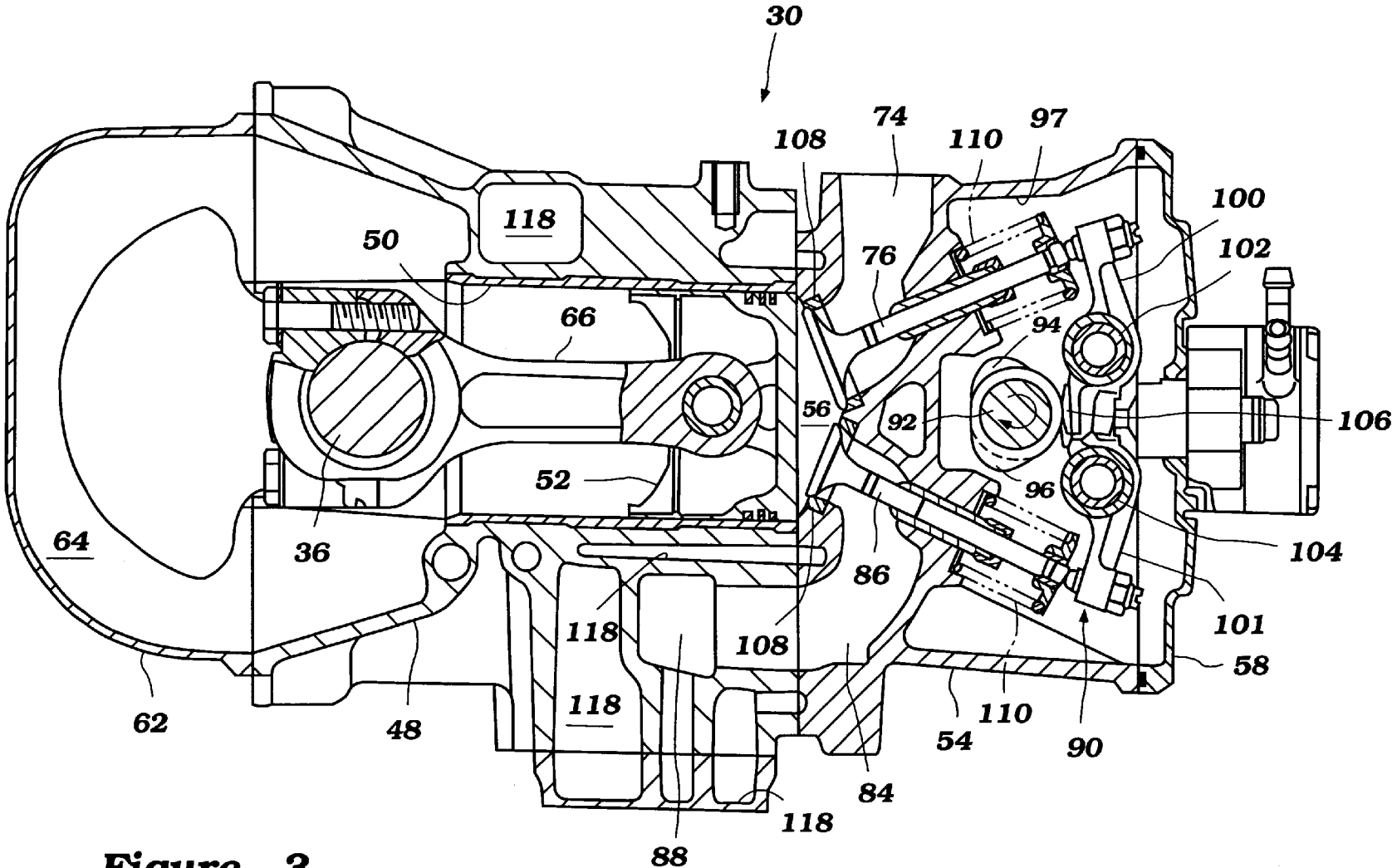
FIG. 3 is a top plan view of the engine. The engine is shown in section.

With reference to FIGS. 1–3, an overall construction of an engine 30 for an outboard motor, which employs a decompression mechanism configured in accordance with a presently preferred arrangement of the present invention, will be described.

Although the present invention is shown in the context of an engine for an outboard motor, various aspects and features of the present invention also can be employed with engines used in other types of marine drives (e.g., a stem drives and in-board/out-board drives) and also, for example, with engines used in land vehicles, such a lawn mower.

The outboard motor comprises a drive unit and a bracket assembly. The bracket assembly supports the drive unit on a transom of an associated watercraft so as to place a marine propulsion device in a submerged position with the watercraft resting on the surface of a body of water. The bracket assembly comprises a swivel bracket, a clamping bracket, a steering shaft and a pivot pin about which the outboard motor can be tilted or trimmed.

The steering shaft typically extends through the swivel bracket and is affixed to the drive unit. The steering shaft is pivotally journaled for steering movement about a generally vertically extending steering axis within the swivel bracket. The clamping bracket often includes a pair of bracket arms spaced apart from each other and affixed to the watercraft transom. The pivot pin completes a hinge coupling between the swivel bracket and the clamping bracket. The pivot pin extends through the bracket arms so that the clamping bracket supports the swivel bracket for pivotal movement about a generally horizontally extending tilt axis defined by the pivot pin.

The drive unit preferably includes a power head 32, a driveshaft housing and a lower unit. The power head 32 is disposed atop the drive unit and includes the engine 30 and a protective cowling 34. The engine 30 includes a crankshaft 36 that is an output shaft of the engine 30. The driveshaft housing depends from the power head 32 and rotatably supports a driveshaft extending generally vertically and driven by the crankshaft 36. The lower unit further depends from the driveshaft housing and rotatably supports a propulsion shaft extending generally horizontally and driven by the driveshaft through a transmission that couples the shafts together. A propeller is preferably affixed at the end of the propulsion shaft as the propulsion device. The driveshaft and the lower unit together define internal passages that form a discharge section of an exhaust system of the engine 30. At engine speed above idle, the majority of exhaust gases are discharged to the body of water surrounding the outboard motor through the internal passages.

The protective cowling 34 defines a generally closed cavity 40 in which the engine 30 is disposed. The protective cowling 34 preferably comprises a top cowling member 42 and a bottom cowling member 44. The top cowling member 42 preferably is detachably affixed to the bottom cowling member 44 so that a watercraft operator, user, mechanic or repairperson can access the engine 30 for maintenance or for other purposes.

The engine 30 preferably operates on a four-cycle combustion principle. The illustrated engine 30 comprises a cylinder block 48. The presently preferred cylinder block 48 defines two cylinder bores 50. The cylinder bores 50 extend generally horizontally and are vertically spaced from one another. A piston 52 can reciprocate in each cylinder bore 50. A cylinder head member 54 is affixed to the cylinder block 48 for closing each one end of the cylinder bores 50 to define combustion chambers 56 in combination with the cylinder bores 50 and the pistons 52. A cylinder cover member 58 is further affixed to the cylinder head member 54 so as to define a cylinder head assembly together with the cylinder head member 54.

The other end of the cylinder block 48 preferably is closed with a crankcase member 62 that at least partially defines a crankcase chamber 64. The foregoing crankshaft 36 extends generally vertically through the crankcase chamber 64. The crankshaft 36 preferably is connected to the pistons 52 by connecting rods 66 and is rotated by the reciprocal movement of the pistons 52.

As used through this description, the terms "front," forward" and "forwardly" mean at or to the side of the engine 30 where the crankcase member 62 is located, and the terms "rear," "rearward," "rearwardly" and "reverse" mean at or to the opposite side of the front side, unless indicated otherwise or otherwise readily apparent from the context of use.

The engine 30 includes an air induction system for introducing air to the combustion chambers 56. The air induction system preferably includes a plenum chamber member defining a plenum chamber, an intake manifold 70 defining air intake passages 72, charge formers 80 and associated intake ports 74 formed in the cylinder head member 54. The air intake passages 72 and the intake ports 74 are associated with the respective combustion chambers 56. Intake valves 76 repeatedly open and close the intake ports 74. When the intake ports 74 are opened, the air intake passages 72 communicate with the associated combustion chambers 56.

The protective cowling 34 has an air intake opening through which the ambient air is introduced into the closed cavity 40. The air in this cavity 40 is then drawn into the air intake passages 72 through the plenum chamber. The intake passages 72 communicate with the combustion chambers 56 such that the air can enter these combustion chambers 56.

The charge formers 80 are preferably located between the plenum chamber member and the intake manifold 70. In the illustrated embodiment, the charge formers 80 include a pair of carburetors 80 each associated with each combustion chamber 56. The carburetors 80 have an air/fuel measurement mechanism. A proper amount of fuel corresponding to the amount of the air supplied to the combustion chambers 56 is provided by the carburetors 80. The air and the fuel form an air/fuel charge or air/fuel mixture. The engine 30, of course, can include a fuel injection system (either direct or indirect) in the place of the carburetors 80, which are shown as one type of charge former that can be employed.

The engine 30 also includes an exhaust system for discharging burnt charges or exhaust gases to a location outside of the outboard motor from the combustion chambers 56. Exhaust ports 84 are defined in the cylinder head member 54. Exhaust valves 86 repeatedly open and close the exhaust ports 84. When the exhaust ports 84 are opened, the combustion chambers 56 communicate with an exhaust manifold 88 which collects the exhaust gases and directs them to the foregoing internal passages defined in the driveshaft housing and the lower unit of the outboard motor.

The engine 30 is provided with a SOHC type valve cam mechanism 90 for actuating both the intake and exhaust valves 76, 86. A single camshaft 92 is journaled for rotation and extends generally vertically in the cylinder head member 54. As seen in FIG. 3, the camshaft 92 rotates clockwise in this view. The camshaft 92 is preferably made of cast iron. Both a top end and a bottom end of the cylinder head member 54 support the camshaft 92.

The crankshaft 36 drives the camshaft 92 in timed relationship. Preferably, the crankshaft 36 drives the camshaft 92 through a cam drive mechanism that comprises a drive sprocket on the crankshaft 36 and a driven sprocket 99 (FIG. 1) on the camshaft 92. A timing belt or chain is wound around the drive and driven sprockets. The camshaft 92 has intake cam lobes 94 and exhaust cam lobes 96. In the illustrated embodiment, the intake cam lobe 94 is located above the exhaust cam lobe 96 at each cylinder bore 50. The cylinder head cover member 58 defines a camshaft chamber or valve cam mechanism chamber 97 therebetween that encloses the camshaft 92 and other related components. In addition to the top and bottom ends of the cylinder head member 54, a middle portion of the cylinder head member 54 and the cylinder head cover member 58 together can support journals 98 of the camshaft 92 (FIG. 2).

As seen in FIG. 3, intake rocker arms 100 and exhaust rocker arms 101 are preferably interposed between the camshaft 92 and the respective valves 76, 86 to push the respective valves 76, 78 toward the combustion chambers 56 when the cam lobes 94, 96 contact the rocker arms 100, 101. That is, the valves 76, 78 are repeatedly open and closed in timed sequence with the angular position of the crankshaft 36 by rotation of the camshaft 92. The intake rocker arm 100 and the exhaust rocker arm 101 are mounted on an intake rocker arm shaft 102 and an exhaust rocker arm shaft 104, respectively, which are journaled on the cylinder head member 54, for pivotal movement. The respective rocker arm shafts 102, 104 are fulcrums for the rocker arms 100, 101. An outer end of each rocker arm 100, 101 contacts a valve tip of each valve 76, 86, while an inner end of each rocker arm 100, 101 defines a portion 106 which lies on the cam lobes 94, 96.

The valves 76, 86 are seated at valve seats 108 unless the rocker arms 100, 101 push them toward the combustion chambers 56 because biasing springs 110 urge them in the opposite direction. When the valves 76, 86 are seated at the valve seats 108, the combustion chambers 56 define completely closed chambers so as to gain a necessary compression ratio in the combustion chambers 56. Under this condition, it is extremely difficult to rotate the crankshaft 36 manually because the opposing force generated by air or air/fuel charge filling the combustion chambers 56 is almost beyond human power. The illustrated engine 30, however, has a manually operated starter assembly 112 (FIG. 2) that is assisted by a decompression mechanism 114. The manually operated starter assembly 112 and the decompression mechanism 114 will be described in great detail shortly.

The engine 30 further includes an ignition or firing system. Each combustion chamber 50 is provided with a spark plug. The spark plug has electrodes exposed into the associated combustion chamber 56 and ignites an air/fuel charge at a selected ignition timing. The ignition system preferably has an ignition coil and an igniter which are connected to an electrical system such as an ECU (electronic control unit) so that an ignition timing can be controlled by the electrical system. In order to enhance and maintain good performance of the engine 30, the ignition timing can be advanced or delayed in response to various engine running conditions.

The engine 30 accumulates heat in, for example, the cylinder block 48, the cylinder head member 54 and exhaust portions. Water jackets 118 are preferably provided for cooling at least these engine portions 48, 54 and exhaust system portions. Cooling water is introduced from the body of water surrounding the outboard motor 30 and is then discharged back into the body of water.

Although not specifically shown, the engine 30 also preferably includes a lubrication system, such as that well known in the art. For instance, the lubrication system can be closed-loop type and can include a lubricant oil reservoir. The reservoir preferably is positioned within the driveshaft housing. An oil pump can pressurize the oil in the reservoir and supply lubricant to delivery passages. The oil is delivered through these passages to engine portions that need lubrication. Lubricant return passages also can be provided through which the oil can return to the oil reservoir. The engine portions that may be lubricated can include the valve cam mechanism 90. The lubricant oil preferably is delivered to the valve cam mechanism 90 through proper delivery passages and the lubricant oil preferably lubricates at least the camshaft 92 and the rocker arms 100, 101.

A flywheel assembly is affixed atop the crankshaft 36. The flywheel assembly includes an AC generator or flywheel magneto that supplies electric power to electrical components including the fuel injection system.

In the illustrated embodiment, the manually operated starter assembly 112 is combined with the flywheel assembly. Any conventional manual starters can be applied as the manually operated starter assembly 112. The engine 30 preferably employs a conventional recoil starter that includes a starter handle 122. The starter handle 122 protrudes forwardly not only from the starter assembly 112 but also from the top cowling member 42 so that the watercraft operator can pull it forwardly. A coiled rope is provided within the starter assembly 112 and couples the starter handle 122 with the flywheel assembly in a manner that is well known. Because the flywheel assembly is coupled with the crankshaft 36, when the operator pulls the handle 122, the rope rotates the crankshaft 36 and the engine 30 rotates accordingly. Then, the operator releases the handle 122 and the rope returns to the initial position with an action of a recoiling mechanism.

As noted above, it is extremely difficult to rotate the crankshaft 36 manually due to the high opposing forces generated by the air or air/fuel charge filling the combustion chambers 56. The decompression mechanism 114 is thus provided for helping the operator start the engine 30.

With primary reference to FIGS. 4–10, the decompression mechanism 114 will now be described in great detail. In the illustrated arrangement, the engine 30 includes two decompression mechanisms 114 to correspond to the two exhaust valves 86. Each decompression mechanism 114 includes a decompression actuator 130 located under each exhaust lobe 96. The actuators 130 are affixed to the camshaft 92 for pivotal movement about a pivot axis extending generally normal to an axis 131 (FIGS. 4 and 8) of the camshaft 92.

Each actuator 130 is configured generally as the letter U in the plan views, as shown in FIGS. 6(*a*) and 6(*c*), and also in the front end view (as to the upper actuator 130) or rear end view (as to the lower actuator 130) both shown in FIG. 6(*d*). That is, the actuator 130 has a pair of side portions 132 and a bridge portion 134 which couples the side portions 132 together by straddling over the body of the camshaft 92.

The respective side portions 132 have apertures 136 at each middle portion. The camshaft 92 also defines a pair of through-holes, each positioned under the respective exhaust cam lobes 96 in the illustrated arrangement and extending normal to the axis 131 of the camshaft 92. Pivot shafts 138 extend through the apertures 136 and the through-holes to affix the respective actuators 130 for pivotal movement on the camshaft 92. Preferably, the pivot shafts 138 are press-fit into the through-holes. The actuators 130 accordingly can pivot about the pivot axes. The pivot shafts 138, thus, act as fulcrums.

Figure 4:
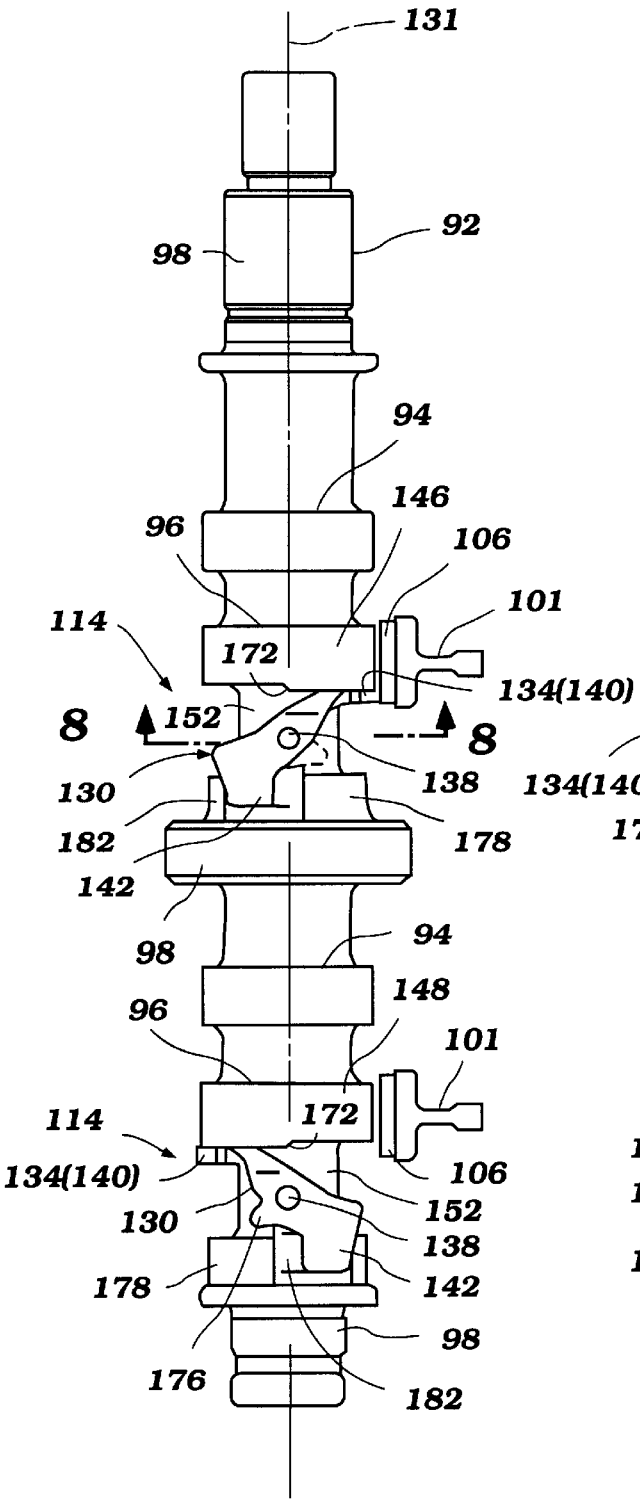
FIG. 4 is an enlarged side view of a camshaft on which the decompression mechanism is provided. In this figure, the camshaft is illustrated under a condition in which the engine stands still or is starting.

Advantageously, each lower part of the side portions 132, which generally are located lower than the aperture 136, has larger mass than the upper rest part of the side portions 132. That is, the total mass of both the lower parts of the side portions 132 is larger than the total mass of the upper part of the side portions 132 plus the bridge portion 134. In the illustrated arrangement, the upper part of the side portions 132 and the bridge portion 134 define a holder section 140, while both of the lower part of the side portions 132 define weight sections 142. The holder section 140 preferably has a cam configuration as best seen in FIGS. 6(*a*) and (*c*). The weight sections 142 urge the holder section 140 into a lowered position, as shown in FIG. 4, when the camshaft 92 does not rotate, i.e., the engine 30 stands still. This lower position is an initial position of the decompression mechanism 114.

Each upper surface of the bridge portion 134 of the actuators 130 preferably has a projection 170 formed thereon and abuts on a lower surface of the exhaust cam lobe 96 at this projection 170 when the decompression mechanism 114 is in the initial position. The actuators 130 are preferably made of sheet metal by a punching and press method using a die. The projection 170 also can be formed in the punching and press processes. Other methods, such as casting and forging, also are practicable.

Figure 8:
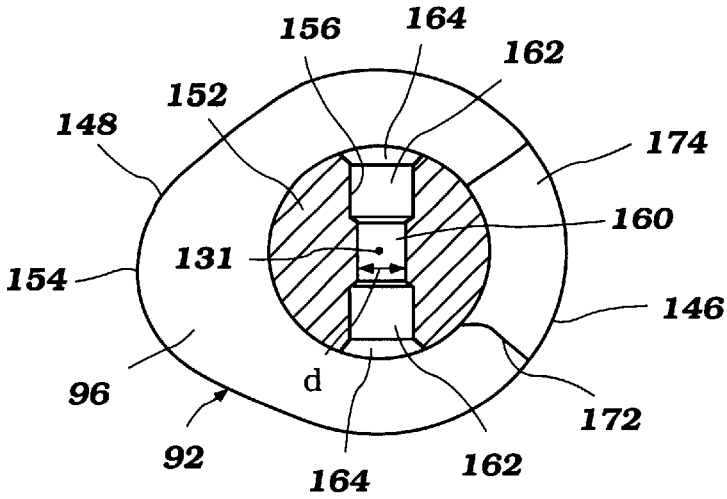
FIG. 8 is a cross-sectional view of the camshaft taken along the line 8—8 of FIG. 4 with the shaft of the decompression mechanism removed.
Figure 9:
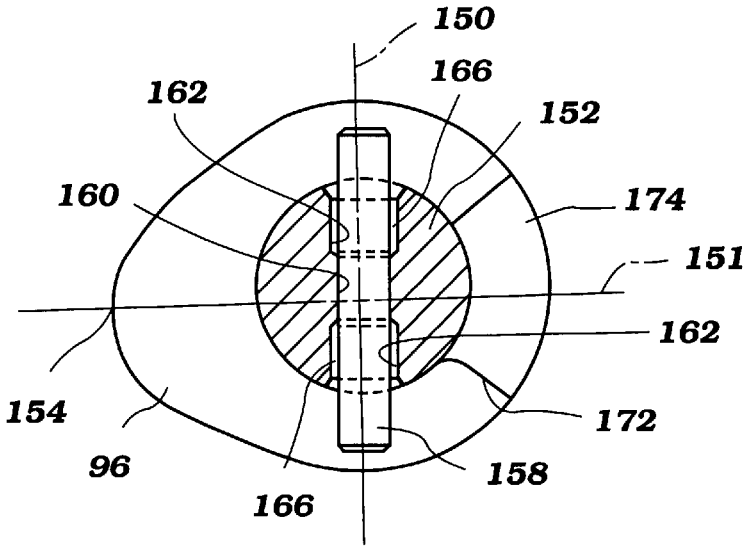
FIG. 9 is a cross-sectional view similar to that shown in FIG. 8 with the shaft of the decompression mechanism installed.

As best seen in FIGS. 8 and 9, each exhaust cam lobe 96 has a base circle portion 146 and a nose portion 148. Each base circle portion 146 has a diameter which defines the base circle of the cam lobe 96. Each nose portion 148 protrudes from the base circle so as to lift the associated portion 106 of the rocker arm 101. In the illustrated arrangement, the base circle portion 146 and the nose portion 148 are divided from each other by a plane 150, which includes the camshaft axis 131 and is normal to another plane 151 that also includes the camshaft axis and an apex 154 of the nose portion 148. The diameter of the base circle portion 146 is larger than a diameter of a shaft portion 156 of the camshaft 92. The apex 154 extends radially from the base circle, which defines an outer surface of the base circle portion 146. In normal engine operations, the nose portion 148 lifts the portion 106 of the exhaust rocker arm 101 so as to open the exhaust valve 86. The intake cam lobe 94 has generally the same configuration as the exhaust cam lobe 96.

The camshaft 92 is preferably manufactured by a casting method. The half area of each exhaust cam lobe 96 including the nose portion 148, is preferably hardened so as to be harder than the other half area that defines the base circle portion 146. This is because the nose portion 148 repeatedly contacts the portion 106 of the rocker arm 101 and hence it is necessary to reduce the likelihood that the nose portion 148 becomes worn. In the illustrated arrangement, the area is hardened in a chilled casting process. In this method, the casting is done under the condition that a metal mold is attached at the nose portion 148 so as to suddenly cool the nose portion 148. The nose portion 148 thus becomes hardened (i.e., white pig iron).

The camshaft 92 defines also a pair of apertures or openings 156 each positioned under the respective exhaust cam lobes 96 and extending normal to the axis 131 of the camshaft 92. Pivot shafts or pins 158 extend through the through-holes 136 of the actuators 130 and the apertures 156 of the camshaft 92 so as to fix the actuators 130 for pivotal movement on the camshaft 92.

Figure 7:
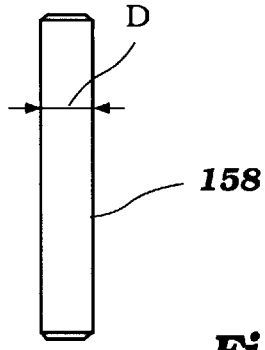
FIG. 7 is a top plan view of a shaft of the decompression mechanism.

As best seen in FIG. 7, each pivot shaft 158 is preferably a straightly configured small pole or stick made of stainless steel. The shaft 158 has an outer diameter D in the illustrated arrangement.

As best seen in FIG. 8, each aperture 156 preferably has three sections, i.e., a first section 160, a second section 162 and a third section 164. The first section 160 is defined at a center portion of the aperture 156 so as to include the axis 131 and has an inner diameter d which is slightly smaller than the outer diameter D of the shaft 158 in the illustrated arrangement. The second section 162 preferably comprises a pair of portions positioned at both sides of the first section 160. Both portions of the second section 162 preferably have an inner diameter generally equal to each other and generally greater than the inner diameter D of the first section 160. The third section 164, in turn, preferably comprises a pair of portions positioned at each outer side of the second sections 162. Each portion of the third section 164 widely opens toward outside. In other words, these portions are tapered inwardly toward the second section 162. In some arrangements, the first section 160 is drilled first with a drill that has an outer diameter corresponding to the inner diameter d of the first section 160. The second section 162 is then drilled with another drill that has an outer diameter corresponding to the inner diameter of the second section 162. Of course, the diameter of the latter drill preferably is greater than the diameter of the former drill. Of course, the configuration can be formed in other manners.

Preferably, each pivot shaft 158 is press-fit into the aperture 156 as seen in FIG. 9. For example, a hydraulically powered press device is available for this press-fitting process and a static load is preferably applied during the process. Because the inner diameter d of the first section 160 is slightly smaller than the outer diameter D of the pivot shaft 158 as noted above, the shaft 158 must broaden the first section 160 during the press-fitting process so as to enter therein. The shaft 158 thus is quite tightly fitted in the aperture 156; or the aperture 156 can grasp the shaft 158. In other words, the respective shafts 158 can be rigidly fixed to the camshaft 92. The tapered third section 164 is advantageous for the press-fitting process because the shaft 158 can be inserted more easily than a construction without this section 164 notwithstanding that the inner diameter d of the first section 160 is smaller than the outer diameter D of the shaft 158.

As described above, in the illustrated arrangement, the shaft 158 is press-fit into the first section 160 of the aperture 156. Because the first section 160 is shorter than the whole length of the aperture 156, the force required for fitting the short length is smaller than the force for fitting the whole length. The chances for undesired deformation of the camshaft 92 are dramatically decreased or eliminated.

As seen in FIG. 9, small spaces 166 are formed between the second section 162 of the aperture 156 and the pivot shaft 158 because the second section 162 has the inner diameter which is slightly larger than the outer diameter D of the shaft 158. The lubricant oil that lubricates the valve cam mechanism 90 can enter the spaces 166 during the engine operation. The oil is quickly removed by the centrifugal forces exerted upon the oil during rotation of the camshaft 92. When, however, the engine speed is reduced, the oil may stay in the spaces 166. The oil entering the spaces 166 immediately before engine stop may remain during periods of engine inoperability.

The actuator 130 is affixed to the shaft 158 preferably during the press-fitting process of the shaft 158 to the aperture 156. Before press-fitting the shaft 158, the actuator 130 can be positioned so as to straddle the shaft portion 152. Axes of the through-holes 136 and an axis of the aperture 156 preferably are accurately aligned with one another. Under this condition, the foregoing press-fitting of the shaft 158 is done so that the shaft 158 penetrates both the through-holes 136 and the aperture 156.

Figure 10:
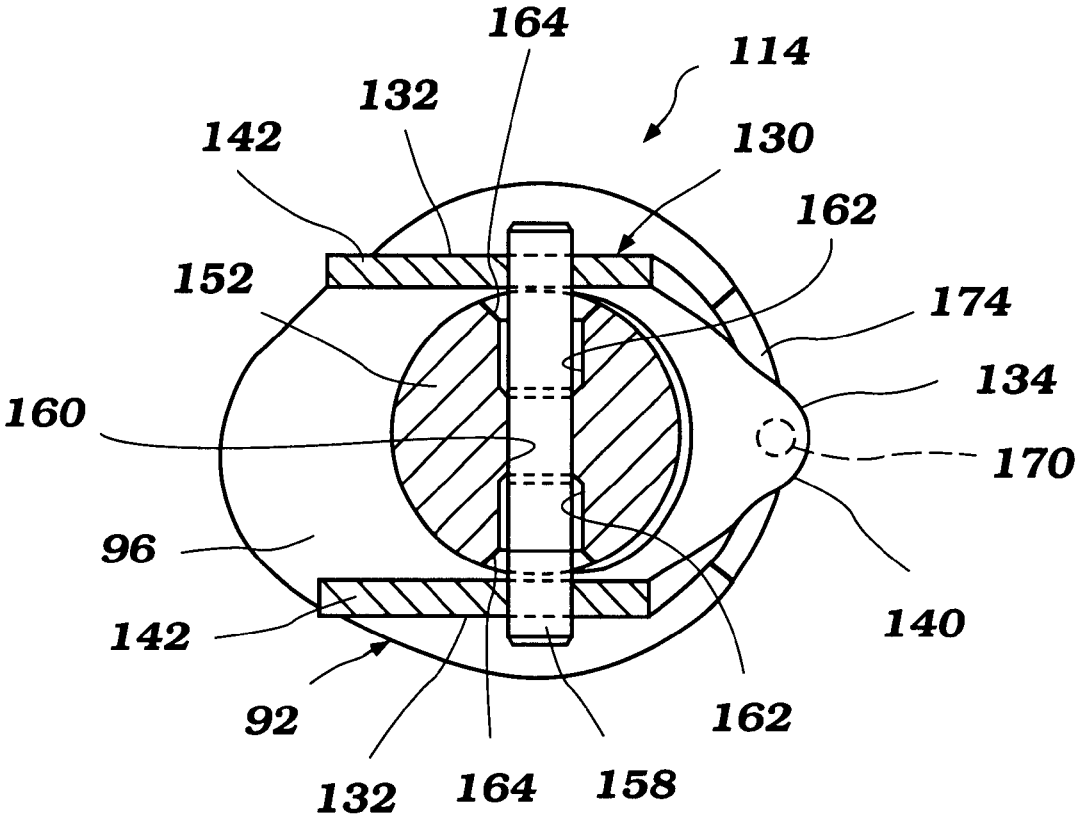
FIG. 10 is a cross-sectional view similar to that shown in FIG. 8 with the shaft of the decompression mechanism installed and the actuator assembled to the shaft.

FIG. 10 illustrates the combination of the camshaft 92, the pivot shaft 158 and the actuator 130. An inner diameter of the through-holes 136 of the actuator 130 are preferably formed slightly larger than the outer diameter D of the shaft 158. Each actuator 130 is thus affixed to the pivot shaft 158 for pivotal movement. The pivot shafts 158 act as fulcrums for the actuators 130.

Under certain conditions chips produced during machining processes or wear dust accumulated during operations of the engine might adhere onto coupling portions of the actuator 130 with the shaft 158. If this occurs, the adhesion of such chips and dust may prevent the shaft 158 from pivoting smoothly and can result in failure of normal operation of the mechanism. The illustrated arrangement, however, can remove the chips and dust efficiently as described below.

As seen in FIG. 4, the weight sections 142 are lowered by gravity when the camshaft 92 does not rotate, i.e., the engine 30 stand still. This lowered position is an initial position of the decompression mechanism 114. As seen in FIGS. 6(*a*)–(*d*), each upper surface of the bridge portion 134 of the actuators 130 preferably has a projection 170 formed thereon that can abut on a lower surface of the exhaust cam lobe 96 when the decompression mechanism 114 is in the initial position. The actuators 130 are preferably made of sheet metal by a punching and press method using a die. The projection 170 also can be formed in the process of the punching and press processes. Other methods such as casting and forging can be also applied.

As best seen in FIG. 8, a plateau 172 is formed at a surface in the area of the base circle portion 146. The plateau 172 protrudes from the lower surface with a small height so as to form a flat surface 174 which extends generally in parallel to the rest of the lower surface. The plateau 172 is positioned generally opposite to the apex 154 relative to the plane 150 and extends so as to have a certain area. Preferably, the flat surface 174 of the plateau 172 is finished by a machining process. Because the base circle portion in this arrangement is not hardened and is therefore softer than the nose portion 148, machining can easily be accomplished. The flat surface 174 defines a positioning surface for the projection 170 of the holder section 140.

The projection 170 abuts on the flat surface 174 of the plateau 172. At the same time, a tip or apex portion of the bridge portion 134 abuts on the portion 106 of the exhaust rocker arm 101 so as to prevent the portion 106 from contacting with the cam lobe 96. Since the surface 174 is machined, a space between the cam lobe 96 and the portion 106 of the rocker arm 101 can be accurately formed so that an optimal decompression function is assured.

During rotation of the camshaft 92, the actuators 130 pivot about the pivot axes of the pivot shafts 158 due to the centrifugal forces generated by the rotation. If the actuators 130 move without any regulation, the weight sections 142 might move upwardly and then the weight sections 142 might interfere with the rocker arms 101. The interference of the weight sections 142 with the rocker arms 101 can prevent the portions 106 from following the cam lobes 96 properly. The illustrated decompression mechanisms 114 therefore preferably include stopper units. Of course, in some constructions, the actuators 130 can be sized and configured such that the weight sections 142 will not interfere with the rocker arms 101.

Figure 5:
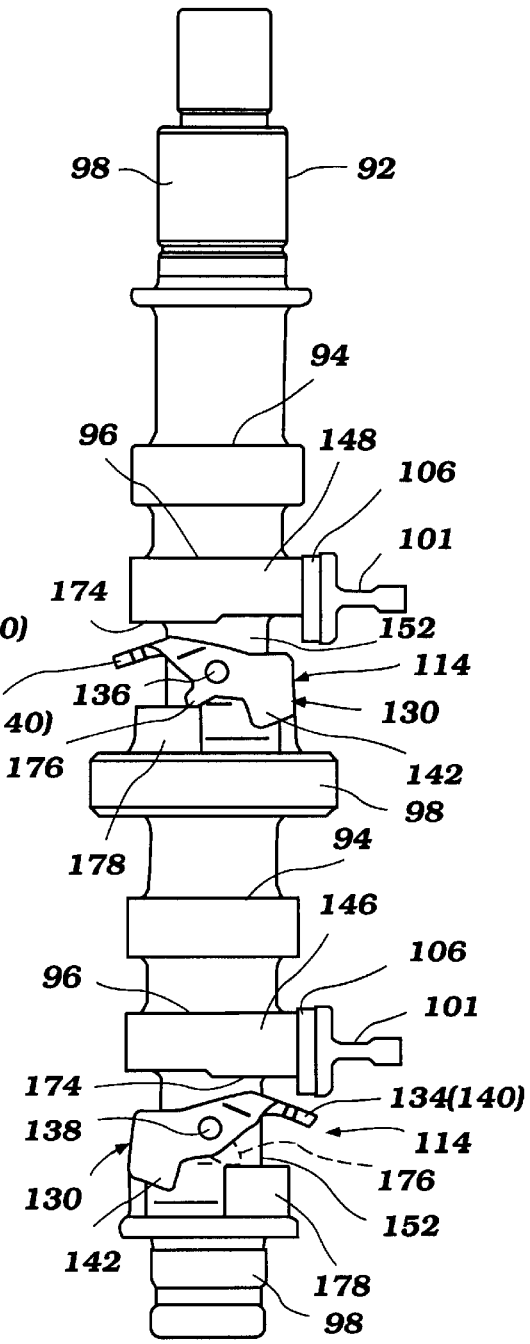
FIG. 5 is an enlarged side view of a camshaft on which the decompression mechanism is provided. This view, which is similar to that shown in FIG. 4, illustrates the engine under a normal running condition.
Figure 6A:
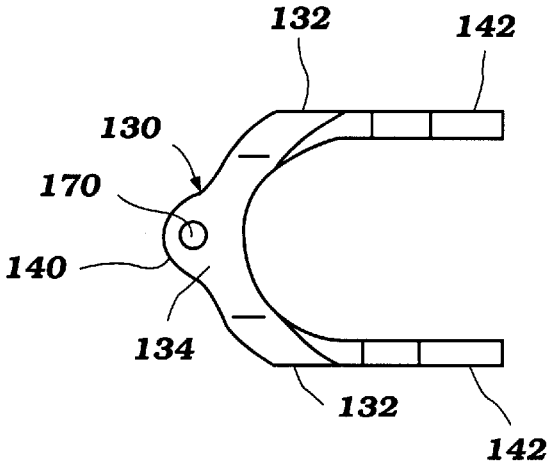
FIG. 6 includes various views of a decompression actuator. In particular, FIG. 6(*a*) is a top plan view, FIG. 6(*b*) is a side view, FIG. 6(*c*) is a bottom plan view and FIG. 6(*d*) is an end view of the decompression actuator.
Figure 6B:
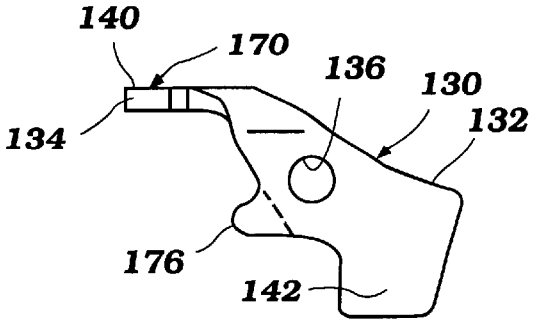
Figure 6D:
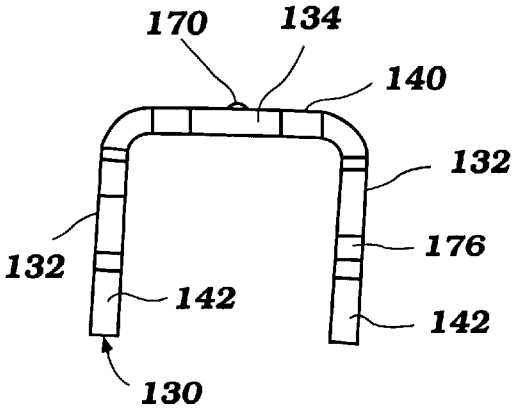
Figure 6C:
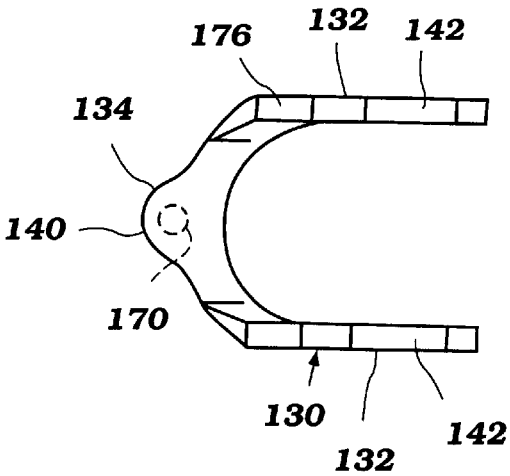

As seen in FIGS. 4 and 5, each stopper unit preferably comprises a stopper section 176 formed at the actuator 130 and a circular projection 178 formed around the camshaft 92. The stopper section 176 preferably extends from one of the side portions 132, specifically, at a portion thereof adjacent to the pivot shaft 138. The circular projection 178 for the upper decompression mechanism 114 extends from the middle journal 98, which is located at a middle portion of the camshaft 92. Another circular projection 178 for the lower decompression mechanism 114 is formed on the camshaft 92. Both of the circular projections 178 have a diameter larger than the diameter of the shaft portion 152 of the camshaft 92 so that the stopper sections 176 can contact the top surfaces of the circular projections 178. The circular projections 178 are formed by the casting method along with the other part of the camshaft 92. The top surfaces of the circular projections 178 accurately define positioning surfaces for the stopper sections 176 and thus are preferably finished by a machining process, like the flat surfaces 174 of the cam lobes 96.

As seen in FIGS. 4, 6 and 9, each circular projection 178 preferably defines a pair of cuts or reliefs 182 where the weight sections 142 of the actuator 130 can nest when the actuator 130 is in the initial position. With the pivotal movement of the actuators 130 by centrifugal force, the top surfaces of the circular projections 178 inhibit the stopper sections 176 from rotating further. The weight sections 142 therefore do not interfere with the portions 106 of the rocker arms 101.

As seen in FIG. 4, when the camshaft 92 stands still or is driven by the crankshaft 36 at an engine speed smaller than a predetermined speed (i.e., a slow speed rotation that occurs when the operator pulls the starter handle 122), the holder sections 140, and more specifically, the projections 170, abut on the flat surfaces 174 of the exhaust cam lobes 96. The predetermined speed can be selected, for example, between about 400 rpm and about 500 rpm and can preferably be about 450 rpm. At the same time, the holder sections 140 hold the exhaust rocker arms 101 so that the exhaust valves 86 are not seated on the valve seats 108. This is because the weight sections 142 are lowered due to gravity. That is, the actuators 130 are placed in the initial position.

Under this condition, the pressure in the combustion chambers 56 is generally equal to the atmospheric pressure because the combustion chambers 56 communicate with the atmosphere through the spaces defined between the valves 86 and the valve seats 108. The pistons 52 thus can reciprocate relatively freely without generating substantial force acting against the rotation of the crankshaft 36. The operator can operate the manual starter assembly 112 or can pull the starter handle 122 easily and the engine 30 starts accordingly.

With the engine 30 starting, the crankshaft 36 drives the camshaft 92 through the cam drive mechanism. As seen in FIG. 5, when the engine speed exceeds the foregoing predetermined speed, the actuators 130 pivot about the pivot axes 138 because the weight sections 142 swing upwardly by centrifugal force exerted upon the weight sections 142. With this pivotal movement of the actuators 130, the holder sections 140 move away from the flat surfaces 174 of the cam lobes 96 and hence the holder sections 140 no longer hold the rocker arms 101. The portions 106 of the rocker arms 101 thus abut on the cam lobes 96 and follow the profile of the cam lobes 96. In the meantime, the stopper sections 176 of the actuators 130 contact with the top surfaces of the circular projections 178 to prevent the actuators 130 from swinging further. When the engine speed exceeds the predetermined speed, the actuators 130 are kept in this stowed position. The holder sections 140 thus do not significantly interfere with the rocker arms 101 once the engine has started.

During normal operation of the engine 30, the lubrication system delivers lubricant oil to the valve cam mechanism 90 as well. As noted above, the oil enters the spaces 166 formed between the second section 162 of the aperture 156 and the pivot shaft 158 immediately before the engine stop. This lubricant tends to remain in the spaces 166 during periods of engine inoperability. At a first moment of the next camshaft rotation, the oil kept in the spaces 166 rushes out to the connecting portions of the actuator 130 with the shaft 158 and impinges the chips and wear dust accumulated and adhering there. The chips and wear dust thus can be removed from the connecting portions. The decompression mechanism 114 can maintain smooth operations without requiring special maintenance works or cleanings accordingly. Thus, the device comprises a self-cleaning arrangement.

As described above, in the illustrated arrangement, each base circle portion 146 of the cam lobe 96, i.e., the half area that includes the plateau 164, is not hardened. The plateau 164 thus is not too hard to be easily machined and the positioning surfaces, i.e., the flat surface 166, can be formed easily by a machining process. In addition, the plateau 164 can define a reduced area where the holder section 140 abuts. The machining process or other forming technique is only required on this small area. The manufacturing cost of the decompression mechanism 114 is therefore minimized even if the mechanism 114 employs the arrangement in which the holder section 140 reclines on the cam lobe 96.

Figure 11:
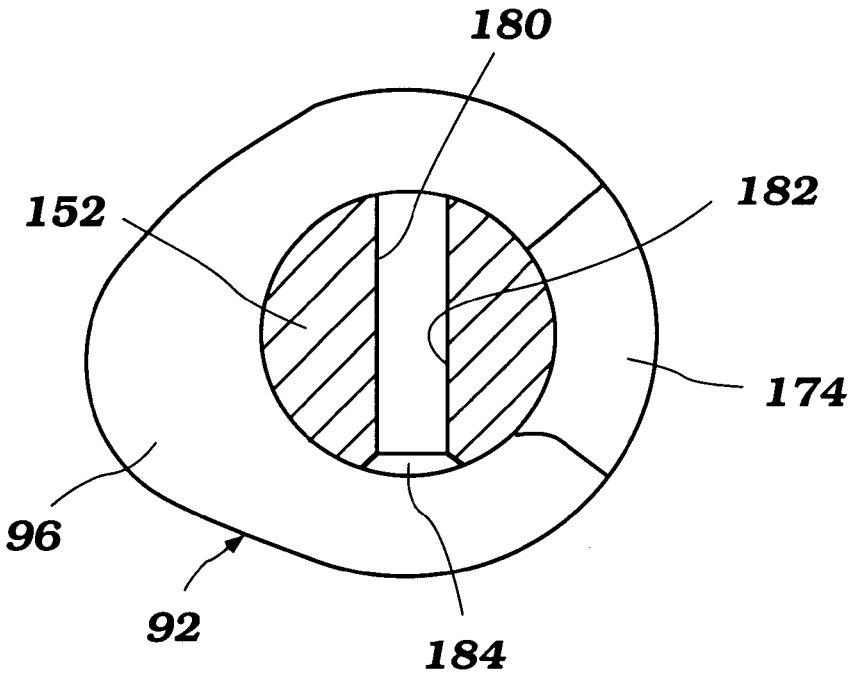
FIG. 11 is a cross-sectional view of another camshaft configured in accordance with certain features, aspects and advantages of the present invention.
Figure 12:
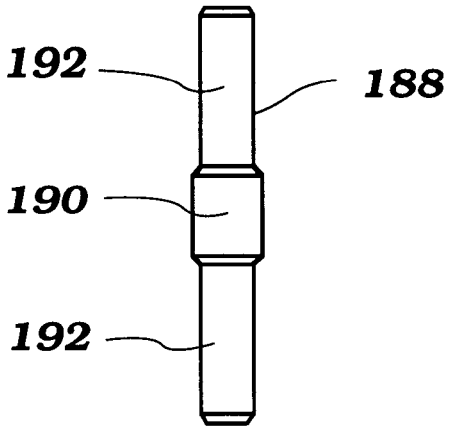
FIG. 12 is a top plan view of another shaft for a decompression mechanism, the shaft being arranged and configured in accordance with certain features, aspects and advantages of the present invention.

FIGS. 11 and 12 illustrate individual parts for another arrangement of the present invention. The same members and elements that have been already described with reference to FIGS. 1–10 are assigned with the same reference numerals and will not be described repeatedly.

As seen in FIG. 11, apertures 180 are defined in this embodiment instead of the foregoing apertures 156 in the first embodiment. Each aperture 180, unlike the aperture 156, comprises two sections, i.e., a first section 182 and a second section 184. The first and second sections 182, 184 of this embodiment generally correspond to the second and third sections 162, 164 of the first embodiment, respectively. That is, each first section 182 is generally defined as a straight opening. The second section 184 comprises, unlike the third section 164 of the first embodiment, only one portion positioned at one outer side of the first section 182. However, similarly, the portion of the second section 184 widely opens toward outside, i.e., the portion is tapered inwardly toward the second section 162.

On the other hand, as seen in FIG. 12, another pivot shaft or pin 188 made of stainless steel is provided for a combination with each aperture 180. The pivot shaft 188 in this embodiment has two sections, i.e., a first section 190 and a second section 192. The second section 192 preferably comprises a pair of portions positioned at both sides of the first section 190. The first section has an outer diameter that is slightly larger than the inner diameter of the first section 182 of the aperture 180. Each portion of the second section 192 has an outer diameter generally equal to one another and generally smaller than the outer diameter of the first section 190.

The pivot shaft 188 is preferably press-fit into the aperture 180 of the camshaft 92 in the same manner as that described above with the first embodiment. In this embodiment, however, the shaft 188 is preferably inserted from the side where the second section 184 exists. Because the outer diameter of the first section 190 of the shaft 188 is slightly larger than the inner diameter of the first section 182 of the aperture 180, the camshaft 92 can rigidly support the shaft 190. Meanwhile, because the outer diameter of the second portion 192 of the shaft 188 is smaller than the outer diameter of the first section 190, spaces are formed between the shaft 188 and the aperture 180 at both the sides of the first section 190. These spaces can have the same function as that of the spaces 166 in the first embodiment.

It should be noted that at least one space defined between the shaft and the aperture is enough in some aspects of the present invention.

In the illustrated embodiment, the exhaust valves 86 are positioned below the intake valves 76. This is advantageous because the carburetors 80 can be placed at relatively high positions and the space below the carburetors are available for other engine related components without interfering with the carburetors 80. The contrary arrangement, however, is also applicable. That is, the intake valves 76 can be positioned below the exhaust valves 86.

The rocker arms can be removed if other cam drive mechanisms are applied. For instance, the DOHC (Double Over Head Camshaft) type mechanism can exclude the rocker arms because a pair of camshafts can directly actuate intake valves and exhaust valves. In this arrangement, the holder sections of the actuators directly hold the valves.

The decompression actuators can hold the intake valves instead of the exhaust valves.

In the illustrated arrangement, the nose portion of the cam lobe occupies generally half of the area thereof. This proportion or percentage to the entire area can be altered. For example, areas of about 30%, 40% and 60% also are practicable inasmuch as the area includes the nose apex and excludes the projection. In addition, the camshaft itself can be made by suitable forging methods.

Of course, the foregoing description is that of preferred embodiments of the present invention, and various changes and modifications may be made without departing from the spirit and scope of the invention, as defined by the appended claims.

What is claimed is:

1. An internal combustion engine comprising a cylinder block defining at least one cylinder bore, a piston reciprocating in the cylinder bore, a cylinder head member closing one end of the cylinder bore and defining a combustion chamber with the cylinder bore and the piston, an intake passage having an intake port through which air is introduced into the combustion chamber, an intake valve arranged to open and close the intake port, an exhaust passage having an exhaust port through which exhaust products are discharged from the combustion chamber, an exhaust valve arranged to open and close the exhaust port, at least one camshaft arranged for rotation and having cam lobes to activate at least one of the intake valve and the exhaust valve, the camshaft defining an aperture extending therethrough and being positioned next to at least one of the cam lobes, the aperture extending generally normal to an axis of the camshaft, and a decompression mechanism configured to decompress the combustion chamber for starting of the engine, the decompression mechanism including a shaft extending through the aperture, an actuator affixed to the shaft for pivotal movement about an axis of the shaft, the actuator having a first section arranged to hold at least one of the intake valve and the exhaust valve in an open position when the actuator exists in an initial position, and a second section arranged to initially retain the actuator in the initial position and to release the actuator from the initial position when the camshaft rotates, the shaft being rigidly supported by an inner surface of the aperture, and a space extending radially between at least a portion of an outer surface of the shaft and at least a portion of the inner surface of the aperture.

2. The internal combustion engine as set forth in claim 1, wherein the shaft is press-fit into the aperture.

3. The internal combustion engine as set forth in claim 1 additionally comprising a lubrication system arranged to lubricate at least the camshaft, wherein the space is capable of retaining lubricant when the camshaft stands still.

4. The internal combustion engine as set forth in claim 1 additionally comprising rocker arms affixed to the cylinder head member for pivotal movement, wherein the camshaft activates both the intake valves and the exhaust valves via the respective rocker arms, each one of the rocker arms has a portion arranged to contact with one of the cam lobes, each one of the rocker arms pushes the intake valve or the exhaust valve when the portion is lifted by the cam lobe, and the first section holds the portion in a lifted position instead of the cam lobe.

5. The internal combustion engine as set forth in claim 1, wherein the camshaft extends generally vertically, the second section has a weight disposed opposite to the first section relative to the axis of the shaft, and the actuator pivots about the axis of the shaft when the weight moves by centrifugal force produced by the rotation of the camshaft so as to release the first section from holding the intake valve or the exhaust valve in the open position.

6. The internal combustion engine as set forth in claim 1, wherein the engine powers a marine propulsion device.

7. The internal combustion engine as set forth in claim 1, wherein at least one end portion of the shaft extends outwardly beyond the aperture, the actuator is affixed to the end portion of the shaft.

8. The internal combustion engine as set forth in claim 7, wherein the space is formed by a portion of the shaft next to the end portion and the inner surface of the aperture.

9. An internal combustion engine comprising a cylinder block defining at least one cylinder bore, a piston reciprocating in the cylinder bore, a cylinder head member closing one end of the cylinder bore and defining a combustion chamber with the cylinder bore and the piston, an intake passage having an intake port through which air is introduced into the combustion chamber, an intake valve arranged to open and close the intake port, an exhaust passage having an exhaust port through which exhaust products are discharged from the combustion chamber, an exhaust valve arranged to open and close the exhaust port, at least one camshaft arranged for rotation and having cam lobes to activate at least one of the intake valve and the exhaust valve, the camshaft defining an aperture extending therethrough and being positioned next to at least one of the cam lobes, the aperture extending generally normal to an axis of the camshaft, and a decompression mechanism configured to decompress the combustion chamber for starting of the engine, the decompression mechanism including a shaft extending through the aperture, an actuator affixed to the shaft for pivotal movement about an axis of the shaft, the actuator having a first section arranged to hold at least one of the intake valve and the exhaust valve in an open position when the actuator exists in an initial position, and a second section arranged to initially retain the actuator in the initial position and to release the actuator from the initial position when the camshaft rotates, the shaft being rigidly supported by an inner surface of the aperture, a space being defined between the shaft and at least a portion of the inner surface of the aperture, the inner surface of the aperture having at least two diameters, and the shaft being supported by a portion of the aperture that defines a smaller diameter.

10. An internal combustion engine comprising a cylinder block defining at least one cylinder bore, a piston reciprocating in the cylinder bore, a cylinder head member closing one end of the cylinder bore and defining a combustion chamber with the cylinder bore and the piston, an intake passage having an intake port through which air is introduced into the combustion chamber, an intake valve arranged to open and close the intake port, an exhaust passage having an exhaust port through which exhaust products are discharged from the combustion chamber, an exhaust valve arranged to open and close the exhaust port, at least one camshaft arranged for rotation and having cam lobes to activate at least one of the intake valve and the exhaust valve, the camshaft defining an aperture extending therethrough and being positioned next to at least one of the cam lobes, the aperture extending generally normal to an axis of the camshaft, and a decompression mechanism configured to decompress the combustion chamber for starting of the engine, the decompression mechanism including a shaft extending through the aperture, an actuator affixed to the shaft for pivotal movement about an axis of the shaft, the actuator having a first section arranged to hold at least one of the intake valve and the exhaust valve in an open position when the actuator exists in an initial position, and a second section arranged to initially retain the actuator in the initial position and to release the actuator from the initial position when the camshaft rotates, the shaft being rigidly supported by an inner surface of the aperture, a space being defined between the shaft and at least a portion of the inner surface of the aperture, the shaft having at least two diameters, and the inner surface of the aperture supporting the shaft at a portion that has a larger diameter.

11. An internal combustion engine comprising a cylinder block defining at least one cylinder bore, a piston reciprocating in the cylinder bore, a cylinder head member closing one end of the cylinder bore and defining a combustion chamber with the cylinder bore and the piston, an intake passage having an intake port through which air is introduced into the combustion chamber, an intake valve arranged to open and close the intake port, an exhaust passage having an exhaust port through which exhaust products are discharged from the combustion chamber, an exhaust valve arranged to open and close the exhaust port, at least one camshaft arranged for rotation and having cam lobes to activate at least one of the intake valve and the exhaust valve, the camshaft defining an aperture extending therethrough and being positioned next to at least one of the cam lobes, the aperture extending generally normal to an axis of the camshaft, and a decompression mechanism configured to decompress the combustion chamber for starting of the engine, the decompression mechanism including a shaft extending through the aperture, an actuator affixed to the shaft for pivotal movement about an axis of the shaft, the actuator having a first section arranged to hold at least one of the intake valve and the exhaust valve in an open position when the actuator exists in an initial position, and a second section arranged to initially retain the actuator in the initial position and to release the actuator from the initial position when the camshaft rotates, a middle portion of the shaft being rigidly supported by an inner surface of the aperture, and a pair of spaces being defined between either end portion of the shaft and the inner surface of the aperture.

12. The internal combustion engine as set forth in claim 11, wherein a diameter of a middle portion of the aperture is smaller than a diameter of either end portion of the aperture.

13. The internal combustion engine as set forth in claim 11, wherein a diameter of the middle portion of the shaft is larger than a diameter of said either end portion of the shaft.

14. The internal combustion engine as set forth in claim 11 additionally comprising a lubrication system arranged to lubricate at least the camshaft, wherein the spaces are capable of retaining lubricant when the camshaft stands still.

15. The internal combustion engine as set forth in claim 11, wherein at least one end portion of the aperture is chamferred outward.

16. The internal combustion engine as set forth in claim 11, wherein the actuator further has a pair of side portions, and the respective side portions are mounted onto the shaft at the respective end portions thereof.

17. An internal combustion engine comprising a combustion chamber, a valve arranged to open and close the combustion chamber to the atmosphere, a camshaft arranged for rotation and having a cam lobe to activate the valve, the camshaft defining an aperture adjacent to the cam lobe, the aperture extending generally normal to an axis of the camshaft, a pin extending through the aperture, and an actuator affixed to the pin for pivotal movement about an axis of the pin, the actuator including a first section arranged to hold the valve in an open position when the actuator exists in an initial position, and a second section arranged to initially retain the actuator in the initial position and to release the actuator from the initial position when the camshaft rotates, a first portion of the pin being rigidly supported by an inner surface of the aperture, wherein a space extends radially between at least a portion of an outer surface of the pin and the inner surface of the aperture.

18. The internal combustion engine as set forth in claim 17, wherein at least one distal end of the pin existing out of the aperture, the actuator is affixed to the distal end of the pin.

19. The internal combustion engine as set forth in claim 18, wherein the space is formed by a portion of the pin next to the distal end and the inner surface of the aperture.

20. A valve cam mechanism for four-cycle engine having a combustion chamber comprising a valve arranged to open and close the combustion chamber to the atmosphere, a camshaft extending generally vertically, the camshaft being arranged for rotation and having a cam lobe to activate the valve, the camshaft defining an aperture adjacent to the cam lobe, the aperture extending generally normal to an axis of the camshaft, a pin extending through the aperture, and an actuator affixed to the pin for pivotal movement about an axis of the pin, the actuator including a holder section arranged to hold the valve in an open position when the actuator exists in an initial position, and a weight section disposed opposite to the holder section relative to the axis of the pin so as to place the holder section in the initial position, the actuator pivoting about the axis of the pin when the weight moves by centrifugal force produced by the rotation of the camshaft so as to release the holder section from holding the valve in the open position, a first portion of the pin being rigidly supported by an inner surface of the aperture, wherein a space extends radially between a portion of an outer surface of the pin and the inner surface of the aperture.

21. The valve cam mechanism as set forth in claim 20, wherein at least one distal end of the pin existing out of the aperture, the actuator is affixed to the distal end of the pin.

22. The internal combustion engine as set forth in claim 21, wherein the space is formed by a portion of the pin next to the distal end and the inner surface of the aperture.

23. An internal combustion engine comprising a combustion chamber, a valve arranged to open and close the combustion chamber to the atmosphere, a camshaft arranged for rotation and having a cam lobe to activate the valve, the camshaft defining an aperture adjacent to the cam lobe, the aperture extending generally normal to an axis of the camshaft, a pin extending through the aperture, at least one distal end of the pin existing out of the aperture, and an actuator affixed to the distal end of the pin for pivotal movement about an axis of the pin, the actuator including a first section arranged to hold the valve in an open position when the actuator exists in an initial position, and a second section arranged to initially retain the actuator in the initial position and to release the actuator from the initial position when the camshaft rotates, the pin at least in part being rigidly supported by an inner surface of the aperture, wherein a space is defined between the pin in the rest part and the inner surface of the aperture.

* * * * *